US012408726B2

(12) United States Patent
Fina

(10) Patent No.: US 12,408,726 B2
(45) Date of Patent: Sep. 9, 2025

(54) SANDAL WITH DETACHABLE FOOT COVER

(71) Applicant: Paul Fina, Yorkville, IL (US)

(72) Inventor: Paul Fina, Yorkville, IL (US)

( * ) Notice: Subject to any disclaimer, the term of this patent is extended or adjusted under 35 U.S.C. 154(b) by 12 days.

(21) Appl. No.: 18/164,580

(22) Filed: Feb. 4, 2023

(65) Prior Publication Data

US 2024/0260704 A1 Aug. 8, 2024

(51) Int. Cl.
*A43B 3/12* (2006.01)
*A43B 3/24* (2006.01)

(52) U.S. Cl.
CPC ..... *A43B 3/122* (2013.01); *A43B 3/244* (2013.01)

(58) Field of Classification Search
CPC ..... A43B 3/122; A43B 3/244
See application file for complete search history.

(56) References Cited

U.S. PATENT DOCUMENTS 616,460 A * 12/1898 Gartner ..... A43B 3/02 36/1.5
2,367,232 A * 1/1945 Marx ..... A43B 3/24 36/15
2,513,005 A 6/1950 Crawford
2,607,133 A 8/1952 Marlowe
3,000,116 A 9/1961 Ally
3,063,167 A 11/1962 Scholl
3,063,457 A 11/1962 Bittner
3,925,915 A * 12/1975 Colli ..... A43B 3/103 36/11.5
4,193,214 A * 3/1980 Wang ..... A43B 3/122 36/11.5
4,887,369 A 12/1989 Bailey
6,581,255 B2 6/2003 Kay
6,848,199 B1 2/2005 Giannelli
D878,717 S 3/2020 Jackson
10,925,344 B1 2/2021 Fina
11,406,154 B2 8/2022 Fina
2002/0124434 A1 9/2002 Hsin
2002/0194750 A1 12/2002 Feick
2003/0145490 A1 * 8/2003 Tsai ..... A43B 3/122 36/15
2004/0064976 A1 4/2004 Barteet
2004/0187346 A1 9/2004 Bianchi
2005/0016019 A1 * 1/2005 Smith ..... A43C 11/00 36/7.7
2005/0262738 A1 12/2005 Gerber
(Continued)

FOREIGN PATENT DOCUMENTS

EP 2548463 A2 * 1/2013 ..... A43B 3/103
WO WO-2015195121 A1 * 12/2015 ..... A43B 3/103

*Primary Examiner* — Megan E Lynch

(57) ABSTRACT

A sandal or slide with a base which includes a top surface upon which a human foot rests, and first and second opposed side surfaces, the first and second opposed side surfaces each having at least one pin. The sandal also has a foot cover, which is selectively detachable from the base, that includes a planar surface with a first terminal edge and a second terminal edge, and at least one receptacle defined proximate the first and second terminal edges. Each of the at least one receptacle includes an inlet, a neck connected to the inlet, and a bottom connected to the neck, such that the bottom has a protrusion, and the at least one pin engages with an end of the protrusion when the sandal is assembled.

18 Claims, 10 Drawing Sheets

(56) References Cited

U.S. PATENT DOCUMENTS

| | | | | |
|---|---|---|---|---|
| 2007/0101619 | A1 | 5/2007 | Bensing | |
| 2007/0209238 | A1 | 9/2007 | Barteet | |
| 2007/0240336 | A1 | 10/2007 | Richardson | |
| 2007/0261267 | A1 | 11/2007 | Osborn | |
| 2007/0266506 | A1 | 11/2007 | Barteet | |
| 2007/0283594 | A1* | 12/2007 | Sink | A43B 3/126 36/11.5 |
| 2010/0083533 | A1 | 4/2010 | Terner | |
| 2011/0283564 | A1 | 11/2011 | Stillwagon | |
| 2012/0013087 | A1* | 1/2012 | Adams | A63C 17/262 280/11.27 |
| 2013/0255106 | A1* | 10/2013 | Cho | A43B 3/122 36/100 |
| 2014/0208611 | A1 | 7/2014 | De Leon | |
| 2014/0250734 | A1 | 9/2014 | Zheng | |
| 2015/0040434 | A1 | 2/2015 | Perkins | |
| 2015/0351486 | A1 | 12/2015 | Opiyo | |
| 2016/0120258 | A1 | 5/2016 | Azulay | |
| 2016/0242493 | A1 | 8/2016 | Stillwagon | |
| 2017/0318895 | A1 | 11/2017 | Thomasson | |
| 2018/0360158 | A1 | 12/2018 | Cummings | |
| 2019/0183207 | A1 | 6/2019 | Jackson | |
| 2020/0008515 | A1 | 1/2020 | Pellegrino | |
| 2020/0359743 | A1* | 11/2020 | Bentvelzen | G06Q 50/04 |
| 2021/0195986 | A1* | 7/2021 | Fina | A43B 3/122 |

* cited by examiner

SANDAL WITH DETACHABLE FOOT COVER

TECHNICAL FIELD

The present disclosure relates to sandals, also known as slides, and more specifically to sandals or slides with removable foot covers.

BACKGROUND

Shoes have been in use for thousands of years to protect the human foot from the ground, to keep the foot warm, dry, or otherwise protected from the elements. Shoe designers, including designers of sandals or slides, continually look for ways to enhance the appeal of shoes to consumers from a functional and/or aesthetic perspective. However, available sandals or slides, have significant shortcomings. First, most sandals have foot covers that are permanently attached to the base. Such permanent attachment prevents interchanging designs or images on the foot cover. Moreover, when the foot cover wears down, it cannot be replaced, and the whole sandal must be discarded. Most sandals that do include custom designs or images on the foot covers are expensive, preventing consumers from being able to purchase many different pair of sandals. Moreover, the available sandals or slides, that do include interchangeable foot covers are difficult to use, as they typically either contain many different components and are thus difficult to assemble or are susceptible to breaking.

Also, applying increased force to the foot cover of available sandals usually causes the connection between the foot cover and base to fail. Additionally, with other available interchangeable foot covers, achieving a comfortable fit is difficult, and the cover often is not sufficiently secure when assembled. Moreover, manufacturing available interchangeable foot covers is expensive and time consuming. Therefore, there is a need for a sandal or slide that allows interchangeable footcovers with unique designs or images that is inexpensive and easy to assemble, as well as having a comfortable fit and a strong connection between the foot cover and base.

SUMMARY

Being able to interchange foot covers, and thus avoid the purchase of multiple pairs of slides, provides the consumer with many different unique designs at much less expense than if he needed to buy slides without interchangeable foot covers. Additional expense is saved by being able to replace only the foot covers. Foot covers are typically the first portion of the sandal to wear down. Therefore, by replacing the foot cover, the base can still be used.

Moreover, the present disclosure provides an easy-to-use assembly method. The present sandal features a base with laterally projecting pins that engage, and are secured within, receptacles proximate terminal edges of the corresponding foot covers. By placing the pins within an inlet of the receptacles, sliding the pins downward to a bottom of the receptacle and sliding the pins toward an end of a protrusion within the bottom of the receptacle, the sandal is completely assembled. The present disclosure provides an interchangeable foot cover that is easy to assemble and has a strong connection. When the pin is engaged with the end of the protrusion, at least half of the pin is in contact with the receptacle. Further, both the top and bottom portions of the pin contact the receptacle.

One issue with available interchangeable foot covers is that the piece of the foot cover connector which receives the pin does not have sufficient contact with the pin when the sandal is assembled. As a result, when the sandal strikes the ground with each step, the pin slides upward and become disengaged with the receiving portion, causing the sandal to disassemble while being worn.

Moreover, with available interchangeable foot covers, the only portion of the pin which contacts the receiving portion is the head of the pin. In other words, the shaft does not contact the receiving portion since it is difficult to ensure that the width of the receiving portion precisely matches the width of the shaft. Therefore, the width of the receiving portion of available interchangeable foot covers typically is larger than the diameter of the shaft. This results in a less secure connection.

The present method also facilitates a secure connection by having the pin press against the end of the protrusion. Since the top and bottom portions of the pin contact the receptacle, a downward force applied to the base does not disengage the pin from the receptacle. Moreover, the foot of the wearer applies a force to the present interchangeable cover in an opposite direction to the direction which the pin slides within the protrusion. In other words, the protrusion extends from the front of the sandal toward the back of the sandal; whereas, the foot of the wearer applies a force to the foot cover toward the front of the sandal. Therefore, the only surface where there is no engagement between the pin and the receptacle is the direction where no force is exerted on the pin when the sandal is assembled. Accordingly, as the pin presses against the end of the protrusion, the connection is made more secure, facilitating a more reliable connection, while preventing the connection from breaking and potentially injuring the wearer.

Further, since the pin is engaged with the end of the protrusion, the dimension of the protrusion does not need to be as precise as with available interchangeable foot covers while still achieving a secure connection.

Furthermore, the present sandal or slide requires few components, so it is relatively simple and inexpensive to manufacture. Additionally, finding a comfortable fit is facilitated by being able to use different foot covers. The consumer optionally tries different size foot covers until he or she finds the size that best matches his or her feet, improving wearer comfort.

These, as well as other aspects, advantages, and alternatives, will become apparent to those of ordinary skill in the art by reading the following detailed description, with reference, where appropriate, to the accompanying drawings.

The present disclosure includes a sandal or slide with a base. The base includes a top surface upon which a human foot rests, and first and second opposed side surfaces, the first and second opposed side surfaces each having at least one pin. The sandal also has a foot cover, which is selectively detachable from the base, that includes a planar surface with a first terminal edge and a second terminal edge, and at least one receptacle defined proximate the first and second terminal edges. Each of the at least one receptacle includes an inlet, a neck connected to the inlet, and a bottom connected to the neck, such that the bottom has a protrusion, and the at least one pin engages with an end of the protrusion when the sandal is assembled.

In a preferred embodiment, the at least one pin includes a head, a shaft with a diameter smaller than a diameter of the head, and a neck connecting the shaft to the head, wherein the neck is chamfered at an angle $\delta$ with respect to the first or second opposed side surfaces.

In another preferred embodiment, the first and second opposed side surfaces each have a base connector piece, where the base connector piece includes a plate, and a pair of the pins which are attached to, or integral with, the plate. Preferably, an interface between the shaft and the plate includes a fillet.

In yet another preferred embodiment, a width of the inlet is greater than a width of the neck but less than a width of the bottom. Preferably, the inlet, the neck, and the bottom form an L-shape such that the protrusion extends in one direction beyond the neck. Preferably, the protrusion extends perpendicularly to an inlet direction of the at least one pin, and a length of the protrusion is greater than a diameter of the head.

In another preferred embodiment, the receptacle forms a cavity for receiving the corresponding pin, where the cavity includes a top wall, angled side walls connected to the top wall, and an edge surface. Preferably, the angled side walls form an angle λ with respect to the edge surface. In another preferred embodiment, the angle λ is equal to the angle δ, such that the neck is flush with the angled side walls when the sandal is assembled. Preferably, the angled side walls include a vertical segment that is perpendicular to the edge surface. Preferably still, the edge surface engages a surface of the plate with the pair of one pins.

In yet another preferred embodiment, the at least one receptacle is located on a cover connector piece, where the cover connector piece includes a top half which includes the top wall; and a bottom half which includes the angled side walls and the edge surface, such that the top half and the bottom half are permanently affixed to one another.

In another preferred embodiment, the at least one receptacle is located on a cover connector piece, where the cover connector piece includes a pair of the receptacles for receiving a corresponding pair of the pins of the base. Preferably, the pair of receptacles are spaced an equivalent distance from either the first terminal edge or the second terminal edge. Preferably still, the cover connector piece also includes a recessed portion between the pair of receptacles, such that the recessed surface is recessed in relation to the edge surface.

Another embodiment of the present disclosure includes a selectively detachable foot cover for sandals. The selectively detachable foot cover includes a planar surface with a first terminal edge and a second terminal edge, and at least one receptacle defined proximate each of the first and second terminal edges. The at least one receptacle includes an inlet, a neck connected to the inlet, and a bottom connected to the neck. Preferably, the bottom has a protrusion, such that a corresponding pin engages with an end of the protrusion.

In a preferred embodiment, a width of the inlet is greater than a width of the neck but less than a width of the bottom, such that the inlet, the neck, and the bottom form an L-shape where the protrusion extends in one direction beyond the neck. Preferably, the protrusion extends perpendicularly to an inlet direction of the corresponding pin, and a length of the protrusion is greater than a diameter of a head of the corresponding pin.

In another preferred embodiment, the corresponding pin includes, a head, a shaft with a smaller diameter than the head, and a neck connecting the shaft to the head, such that the neck is chamfered at an angle δ with respect to a top surface of the head.

In yet another preferred embodiment, the receptacle forms a cavity for receiving the corresponding pin, such that the cavity includes a top wall, angled side walls connected to the top wall, and an edge surface. Preferably, the angled side walls form an angle λ with respect to the edge surface. Preferably still, the angle λ is equal to the angle δ, such that the neck is flush with the angled side walls when the selectively detachable foot cover is assembled on a sandal. Preferably, the angled side walls include a vertical segment that is perpendicular to the edge surface.

In yet another preferred embodiment, the at least one receptacle is located on a cover connector piece, and the cover connector piece includes a top half which with the top wall, and a bottom half which includes the angled side walls and the edge surface. Preferably, the top half and the bottom half are permanently affixed to one another.

In another preferred embodiment, the at least one receptacle is located on a cover connector piece, and the cover connector piece includes a pair of the receptacles for receiving a corresponding pair of the pins. Preferably, the pair of receptacles are spaced an equivalent distance from either the first terminal edge or the second terminal edge. Preferably still, the cover connector piece includes a recessed portion between the pair of receptacles, such that the recessed surface is recessed in relation to the edge surface.

DETAILED DESCRIPTION

Figure 3:
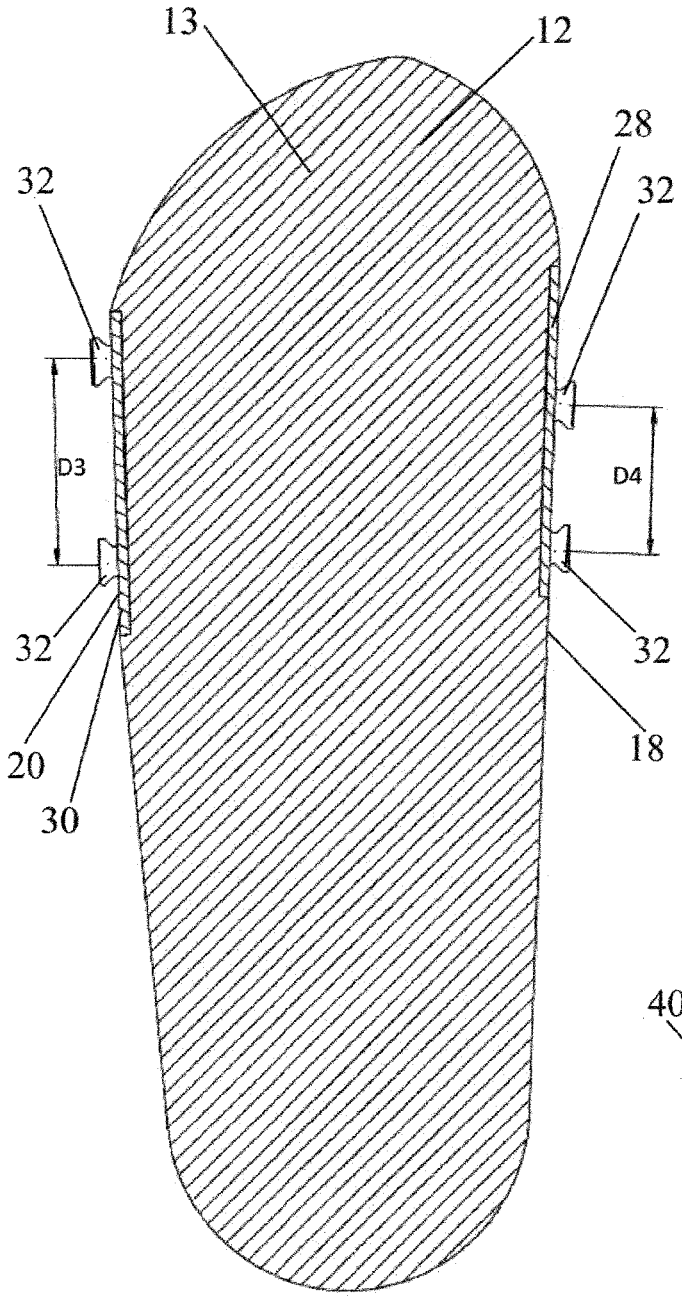
FIG. 3 is a cross section of a base separate from a foot cover, according to an example embodiment.
Figure 4:
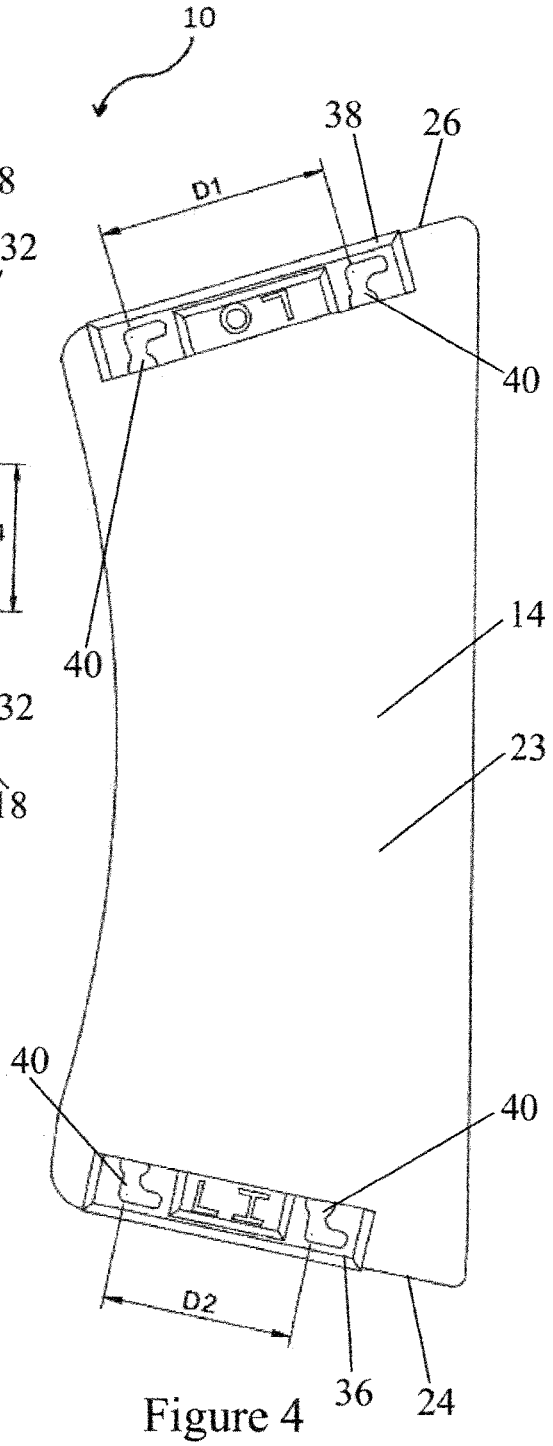
FIG. 4 depicts the foot cover separate from the base, according to an example embodiment.
Figure 5:
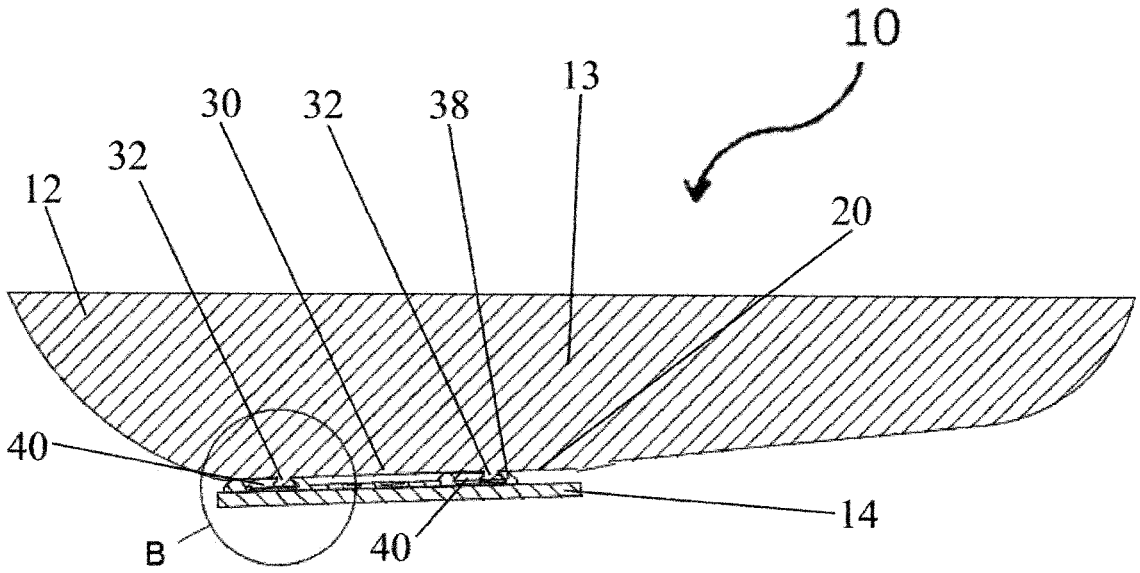
FIG. 5 is a cross-section taken along the line 5-5 and in the direction generally indicted from arrows of FIG. 2.

Referring to FIGS. 1 to 4, a sandal or slide 10 has a base 12 with a body 13, as well as a foot cover 14 which is selectively removable from the base 12 as shown in FIG. 5. Each base 12 includes a top surface 16 upon which a human foot (not shown) rests, as well as a first and second opposed side surfaces 18, 20. The foot cover 14 includes an upper planar surface 22, a lower planar surface 23, and first and second terminal edges 24, 26.

As displayed in FIG. 3, the base 12 preferably includes a first base connector piece 28 on the first side surface 18, and a second base connector piece 30 on the second side surface 20. The first and second opposed side surfaces 18, 20 are optionally recessed within the body 13 of the base 12, and the base connector pieces 28, 30 are optionally placed within the recesses of the first and second opposed side surfaces. Alternatively, the base connector pieces 28, 30 are attached to the first and second opposed side surfaces 18, 20 which are flush with the body 13 of the base 12.

Additionally, the first and second opposed side surfaces 18, 20 each include at least one pin 32, and in a particular embodiment, a pair of pins 32. FIG. 3 shows the base 12, with a distance D3 defined between the pair of pins 32 on the second side surface 30 and a distance D4 defined between the pair of pins on the first side surface 28. The base 12 is preferably made of a flexible PVC or rubber-like material, or other suitable material known to those in the art.

FIG. 4 shows the foot cover 14 with the lower planar surface 23 which has a first cover connector piece 36 proximate the first terminal edge 24, and a second cover connector piece 38 proximate the second terminal edge 26. The cover connector pieces 36, 38 include at least one, and preferable, a pair of receptacles 40, which will be described in greater detail below. A distance D2 is defined between the receptacles 40 on the first cover connector piece 36, and a distance D1 is defined between the receptacles 40 on the second cover connector piece 38. Moreover, D2 is preferably equal to D4 so that the pins 32 on the first side surface 18 are engaged with the respective receptacles 40 on the first terminal edge 24. Similarly, D1 is preferably equal to D3, so that the pins 32 on the second side surface 20 are engaged with the respective receptacles 40 on the second terminal edge 26. Preferably D1 is greater than D2 and D3 is greater than D4. In a preferred embodiment, the foot of the wearer is placed against the lower planar surface 23 when the sandal 10 is assembled.

Figure 1:
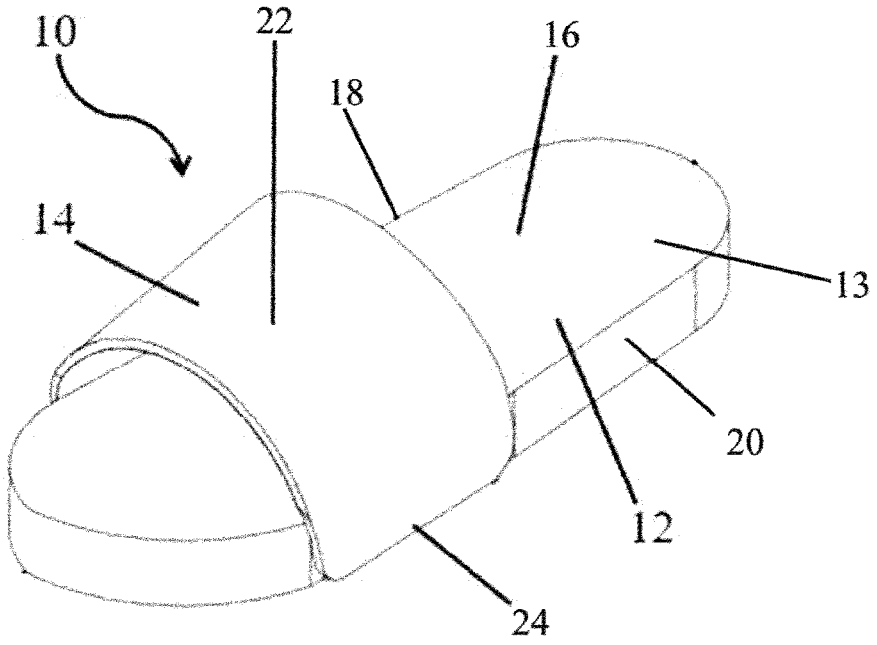
FIG. 1 depicts an example article of footwear, a sandal or slide, having an interchangeable cover, according to an example embodiment.
Figure 2:
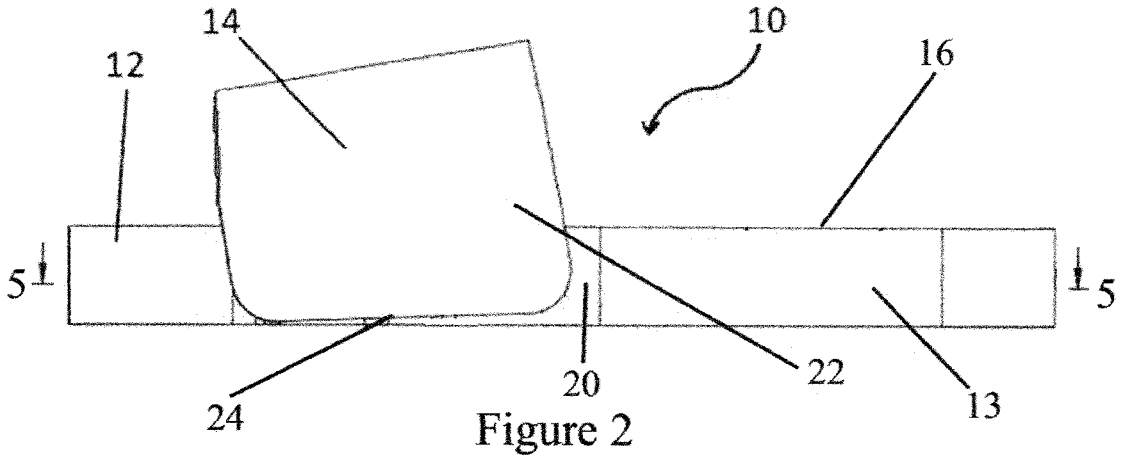
FIG. 2 depicts a side view of the sandal or slide of FIG. 1, according to an example embodiment.
Figure 6:
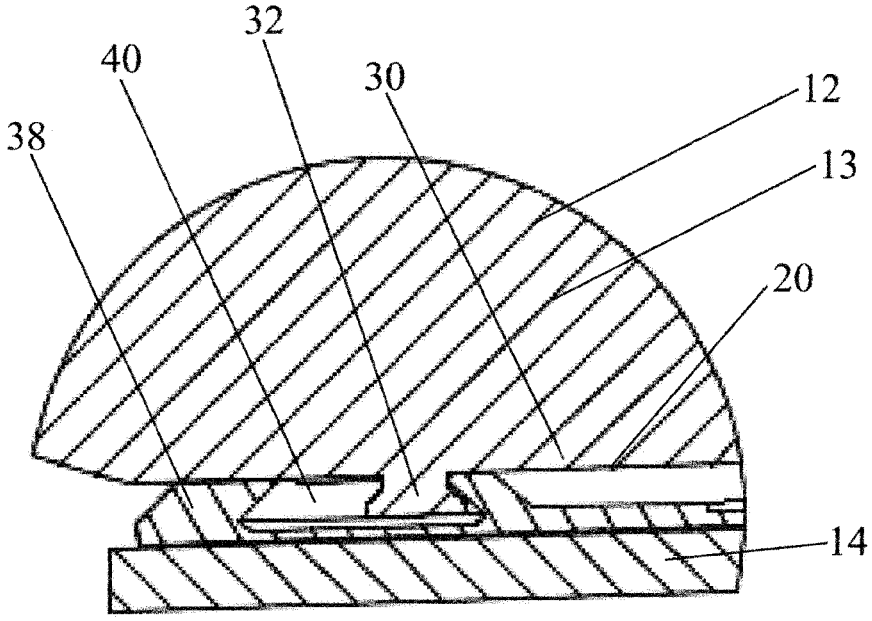
FIG. 6 depicts an enlarged view of an example affixation of the foot cover to the base of FIG. 5, according to an example embodiment.

FIGS. 5 and 6, each depict a cross-section taken along the lines 5-5 in FIG. 1. In the embodiment shown in FIGS. 5 and 6, the base connector piece 30, with the corresponding pins 32, is integral with the body 13 of the base 12. Additionally, as shown in FIG. 4, the cover connector piece 38 is attached to the lower planar surface 23 of the cover 14. It is also contemplated that the cover connector piece 38 is optionally integral with the lower planar surface 23, such that the cover 14 is a single component. As depicted in FIGS. 5 and 6, sandal 10 is assembled, and the pins 32 are engaged with the receptacle 40, such that the connection between the base 12 and the cover 14 is secure.

Figure 7:
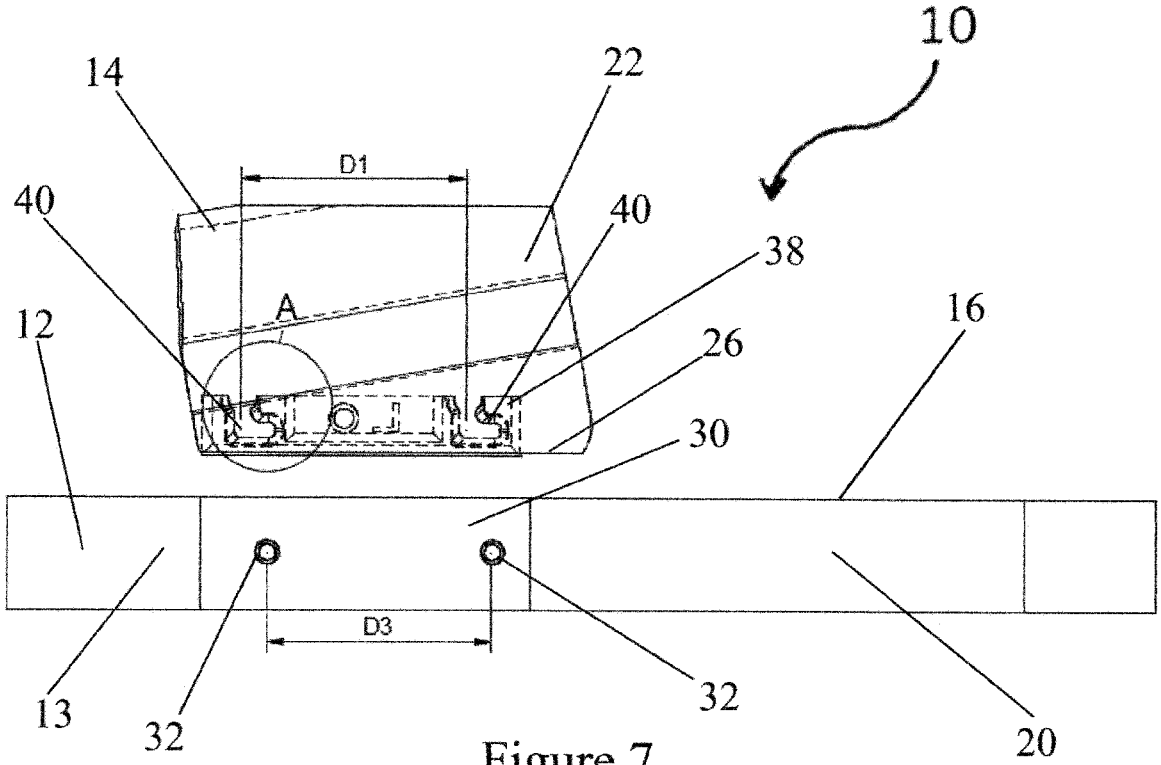
FIG. 7 depicts a side exploded view of the sandal or slide of FIG. 1, according to an example embodiment.
Figure 8:
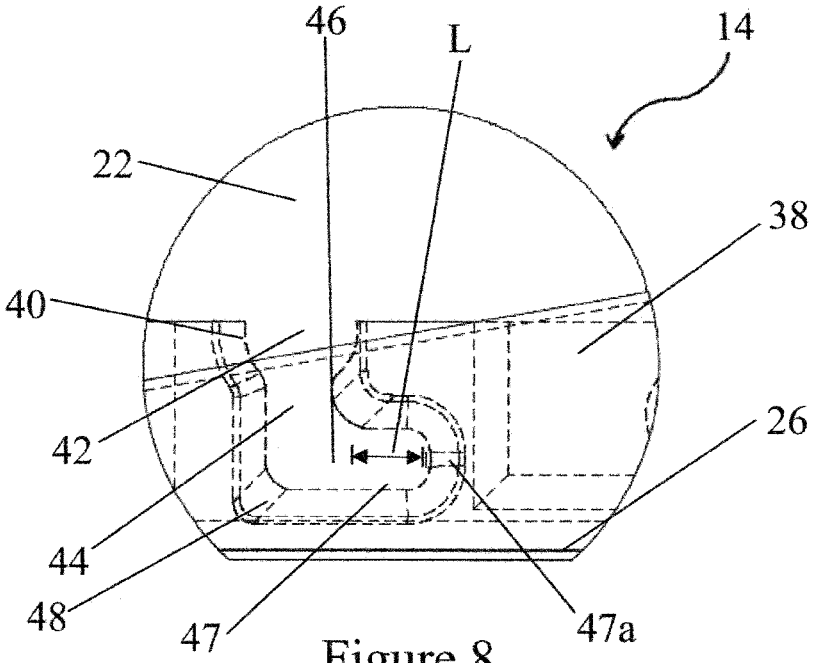
FIG. 8 depicts an enlarged view of the foot cover and the base from the foot cover of FIG. 7, according to an example embodiment.

Referring to FIG. 7 the sandal or slide 10, is disassembled into its components, the base 12 and the foot cover 14. FIG. 8 shows an enlarged view of the receptacles 40 according to an example embodiment. In a preferred embodiment, the receptacle 40 includes an edge surface 41, an inlet 42, a neck 44, and a bottom 46 with a protrusion 47 where the pin 32 rests against an end 47*a* of the protrusion. Additionally, the protrusion 47 has a length L measured from the edge of the neck 44 and extending to a center of the end 47*a* of the protrusion. In one embodiment, the end 47*a* of the protrusion 47 is semicircular in shape. However, it is also contemplated that the end 47*a* of the protrusion 47 preferably includes a straight segment between the curved regions.

Figure 9:
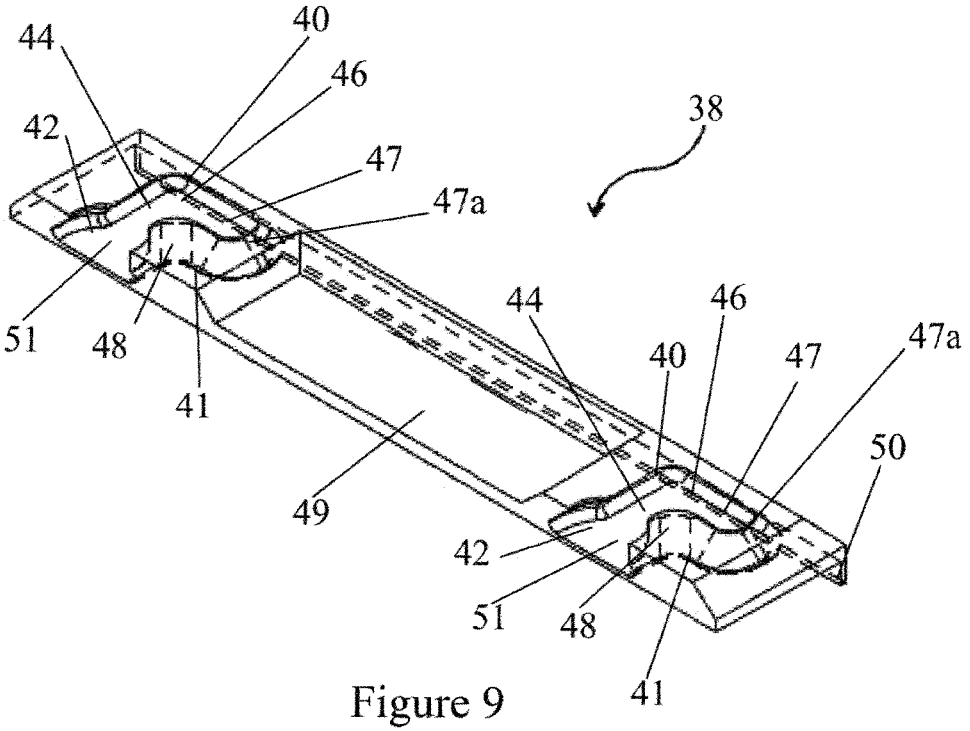
FIG. 9 depicts a top perspective view of a cover connector piece, according to an example embodiment.

As shown in FIG. 9, the cover connector piece 38 preferably includes two receptacles 40. In a preferred embodiment, the receptacle 40 forms a cavity which receives the pin. Specifically, beneath the edge surface 41, angled side walls 48 form the sides of the receptacle 40.

Figure 11:
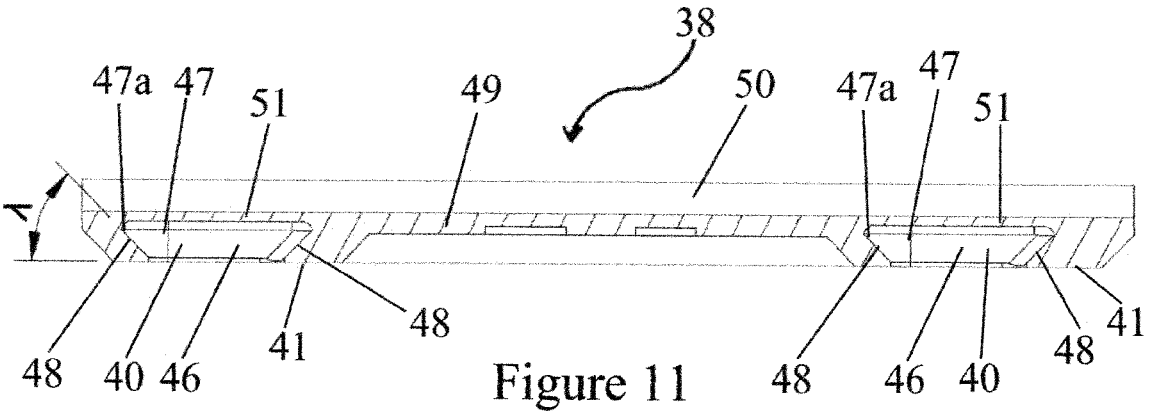
FIG. 11 is a cross-section taken along the line 11-11 and in the direction generally indicted from arrows of FIG. 10.
Figure 11A:
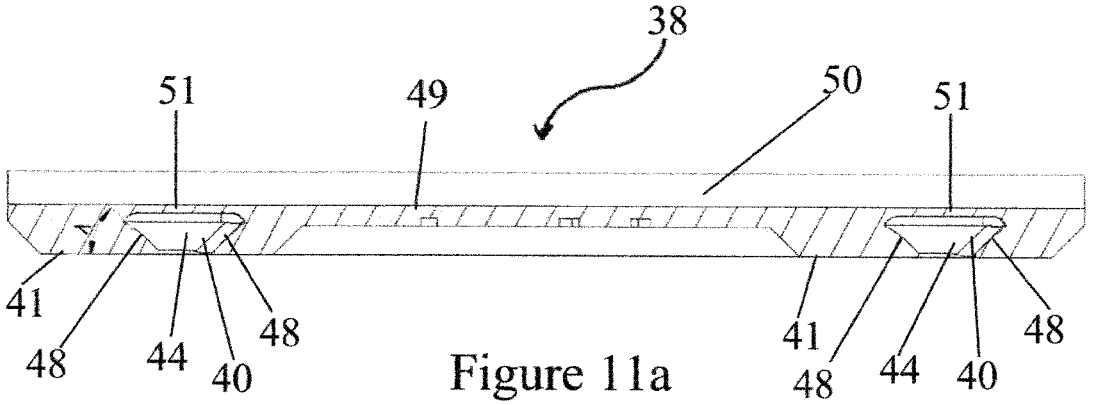
FIG. 11*a* is a cross-section taken along the line 11*a*-11*a* and in the direction generally indicted from arrows of FIG. 10.
Figure 12:
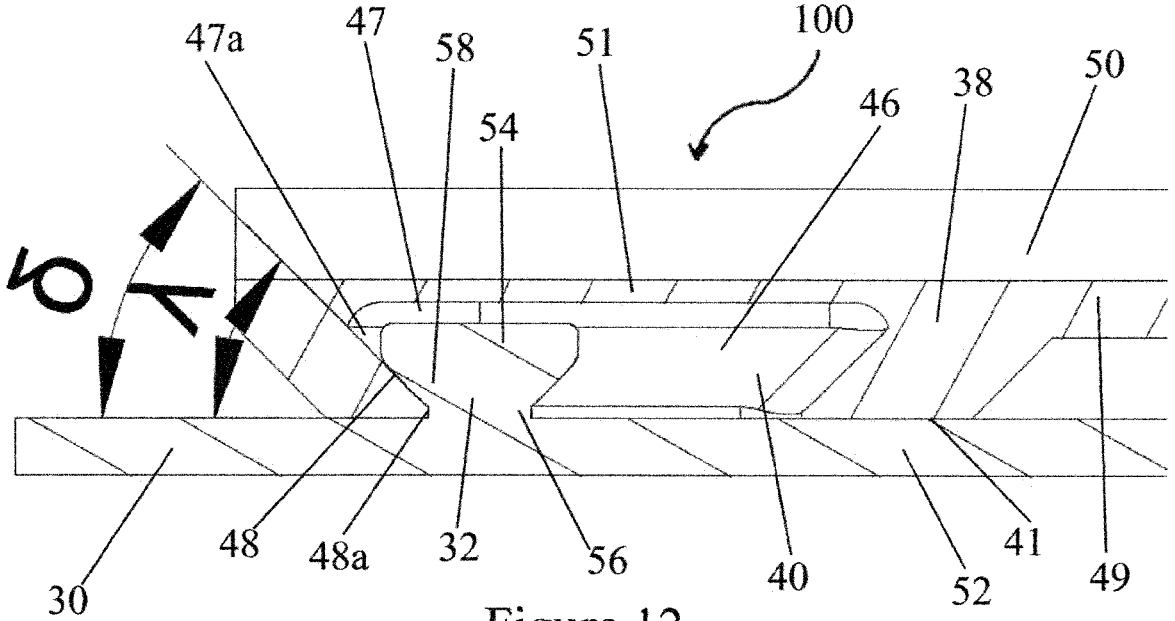
FIG. 12 depicts a cross section of a cover connector piece affixed to a base connector piece, according to an example embodiment.
Figure 13:
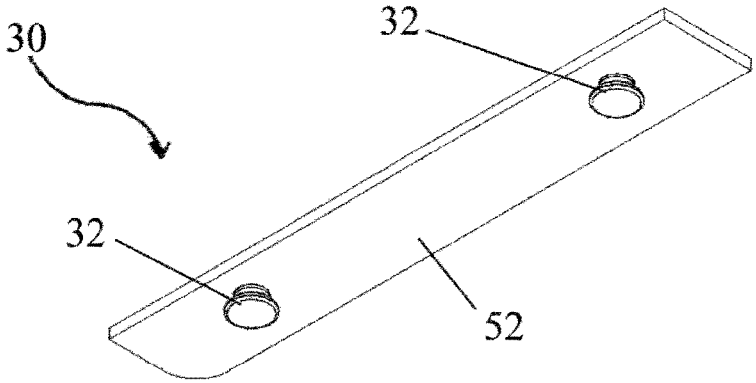
FIG. 13 depicts a bottom perspective view of a base connector piece, according to an example embodiment.
Figure 14:
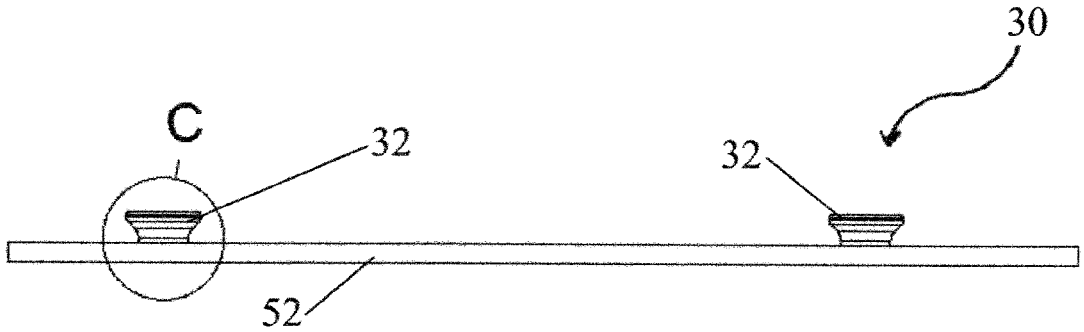
FIG. 14 depicts a side plan view of the base connector piece of FIG. 13, according to an example embodiment.
Figure 15:
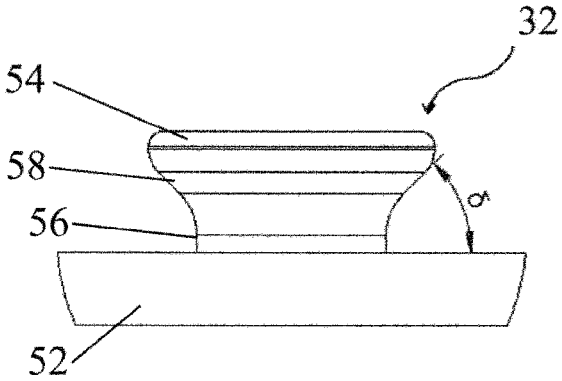
FIG. 15 depicts an enlarged view of a pin of the base connector piece, according to an example embodiment.
Figure 15A:
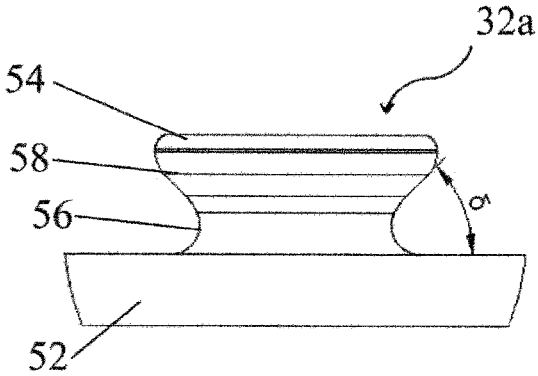
FIG. 15*a* depicts an enlarged view of an alternate pin of the base connector piece, according to an example embodiment.
Figure 16:
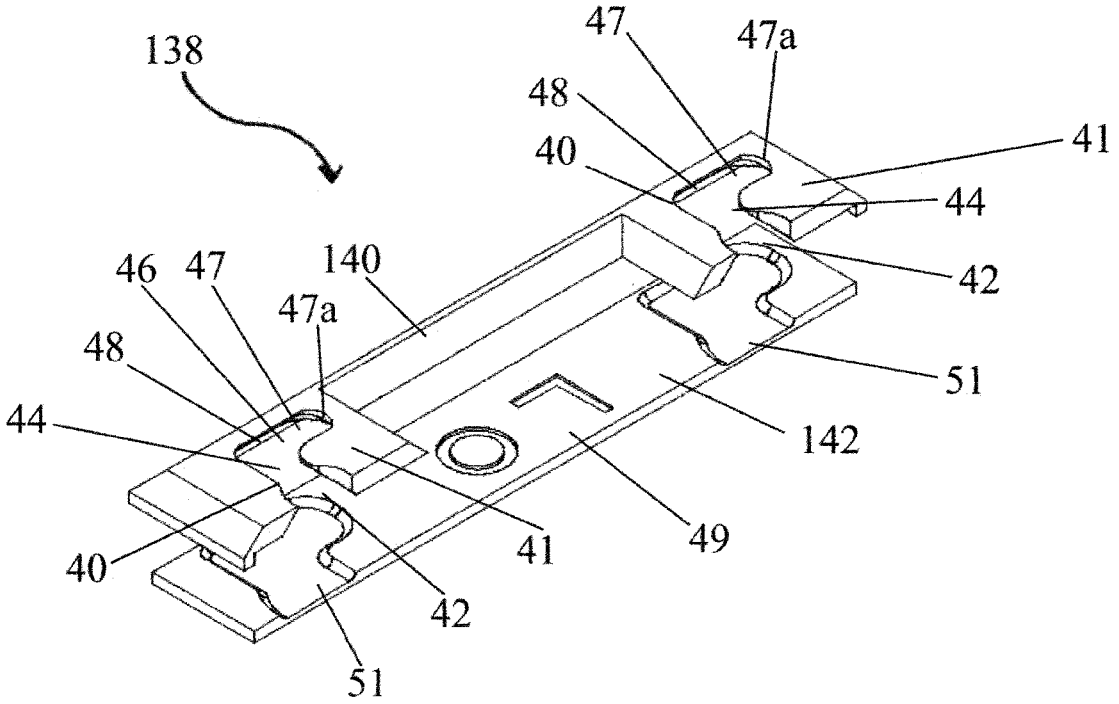
FIG. 16 depicts a top perspective view of an alternate cover connector piece, according to an example embodiment.

Referring to FIG. 12, an embodiment of the base connector piece 30 and the cover connector piece 38 is generally designated 100. As shown in FIGS. 11, 11*a*, and 12, the angled side walls 48 form an angle $\lambda$ with respect to the edge surface 41. Preferably, the angled side walls 48 include a include a vertical segment 48*a* that is perpendicular to the edge surface 41.

Figure 10:
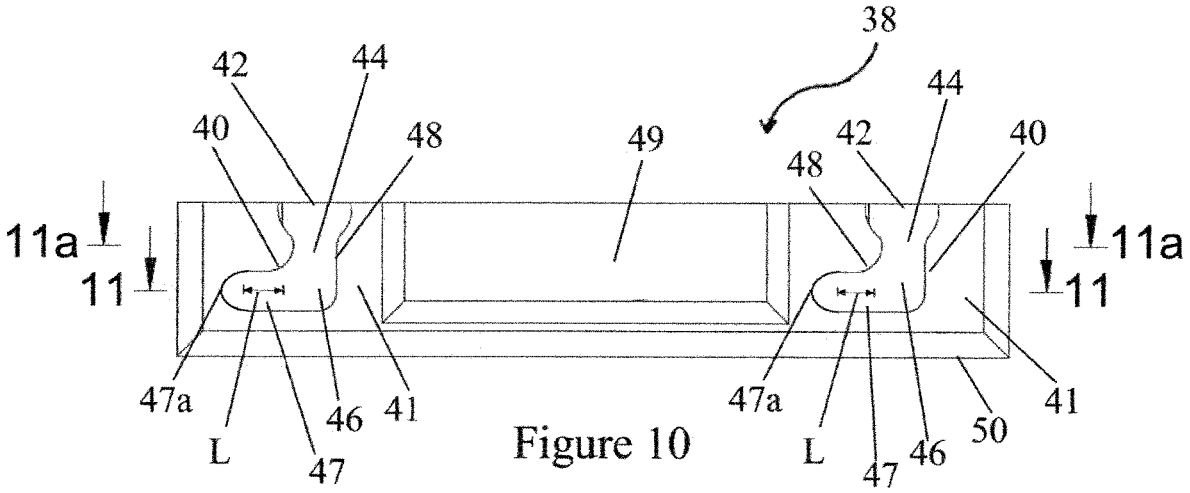
FIG. 10 depicts a top plan view of the cover connector piece of FIG. 9, according to an example embodiment.

Referring to FIGS. 8 and 10, a width of the inlet 42 is greater than a width of the neck 44 but less than a width of the bottom 46. Moreover, the inlet 42, the neck 44, and the bottom 46 form an L-shape such that the protrusion 47 extends in one direction beyond the neck 44. Referring to FIG. 9, a space between the receptacles 40 preferably includes a recessed surface 49 which is recessed in relation to the edge surface 41.

In a preferred embodiment, the recessed surface 49 includes a label which includes letters indicating the location of the cover connector piece 36, 38. For example, if the cover connector piece 36, 38 is located on the outside of the left cover 14, the recessed surface 49 optionally includes letters "L" and "O" for left and outside. These labels are optionally stickers applied to the recessed surface 49. Alternatively, the labels are formed by indentations in the recessed surface 49. However, alternate labels are contemplated as is known in the art.

Further, the cover connector piece 38 optionally includes a lip 50 which is secured to the second terminal edge 26. The optional lip 50 provides an additional surface for securing the cover connector piece 38 to the cover 14. Referring to FIGS. 11 and 11*a*, the receptacle 40 also includes a top wall 51 which is connected to the angled edge walls 48.

Referring now to FIGS. 13 to 15*a*, the base connector piece 30 optionally includes a plate 52 with a pair of pins 32 extending from the plate. The pin 32 includes a head 54, a shaft 56, and a neck 58 which connects the head 54 and the shaft 56. A diameter of the head 54 is greater than a diameter of the shaft 56. Preferably, the neck 58 is chamfered at an angle $\delta$ with respect to the plate 52 and the second opposed side surface 30. Preferably still, a top surface of the head 54 is parallel to the plate 52.

In a preferred embodiment, the angle λ is equal to the angle δ, such that the neck 58 is flush with the angled side walls 48 when the sandal 10 is assembled. Further, in a preferred embodiment, the length L of the protrusion 47 is greater than the diameter of the head 54. Preferably, the interface between the shaft 56 and the plate 52 includes a fillet, and the top edge of the head 54 is rounded.

Moreover, a height of the pin 32 above the plate 52 is preferably less than a distance between the edge surface 41 and the top wall 51, such that there is a space between the top of the head 54 and the top wall.

Figure 17:
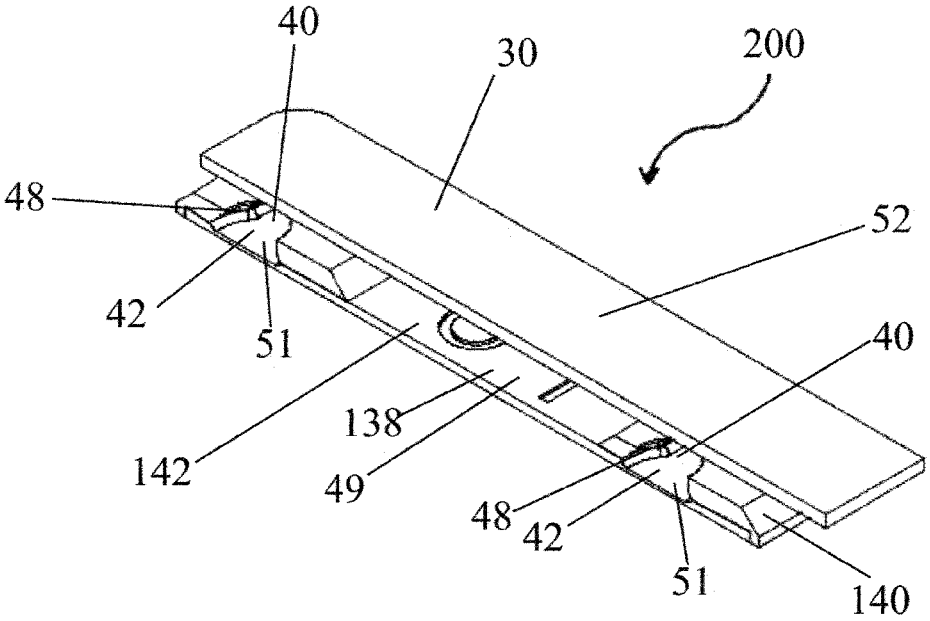
FIG. 17 depicts a top perspective view of an example affixation of an alternate cover connector piece with the base connector piece, according to an example embodiment.

FIG. 17 shows an alternate embodiment of the cover connector piece 38, generally designated 138. Elements shared with the cover connector piece 38 are indicated with identical reference numbers. The cover connector piece 138 includes a bottom half 140 and a top half 142. When attached, the bottom half 140 and the top half 142 form a complete cover connector piece 138, which preferably has the same structure as the cover connector piece 38. In particular, the top half 142 includes the recessed surface 49 and the top wall 51. Optionally, the top half 142 includes part of the angled side wall 48 depending on the depth of the bottom half 140 and the top half 142. Including the cover connector piece 138 as the bottom half 140 and the top half 142 improve the manufacturability of the cover connector piece 138. In particular, forming a cavity in plastic parts is difficult with traditional manufacturing techniques including injection molding or 3D printing.

Figure 18:
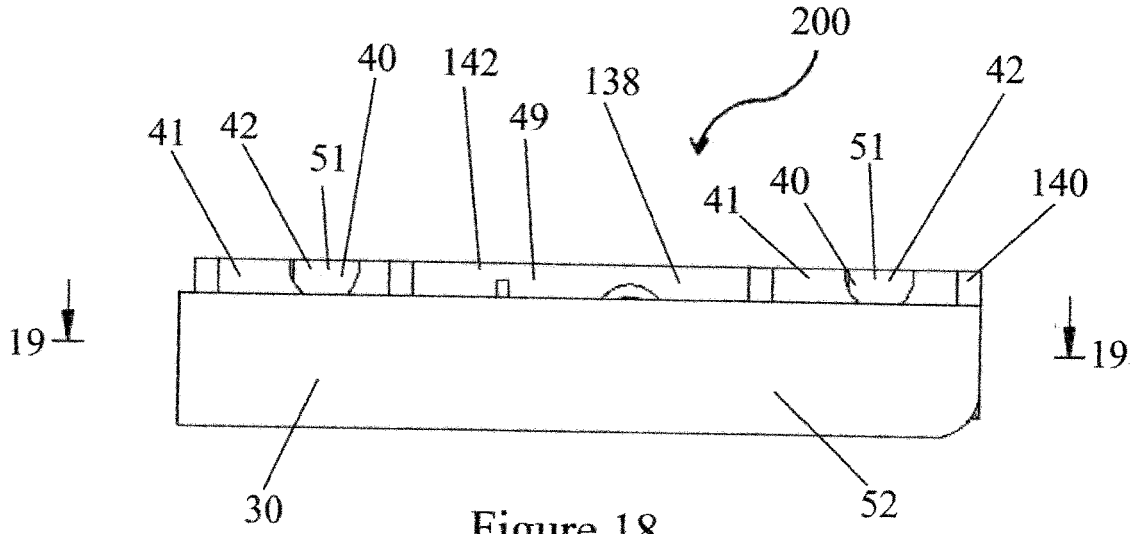
FIG. 18 depicts a top plan view of the example affixation of a cover connector piece with the base connector piece of FIG. 17, according to an example embodiment.
Figure 19:
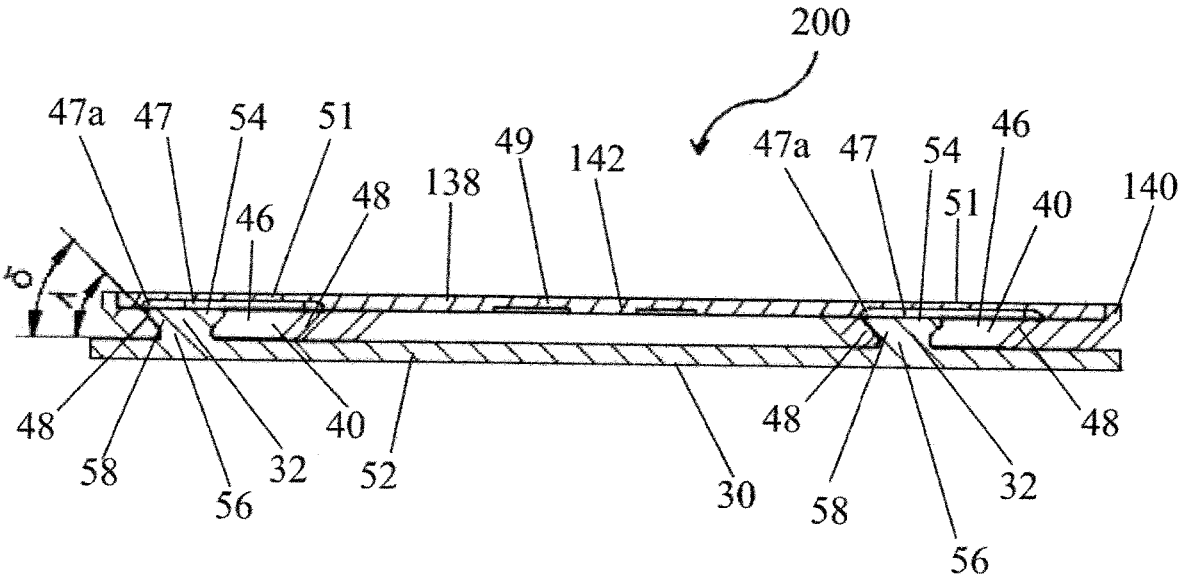
FIG. 19 is a cross-section taken along the line 19-19 and in the direction generally indicted from arrows of FIG. 18.
Figure 20:
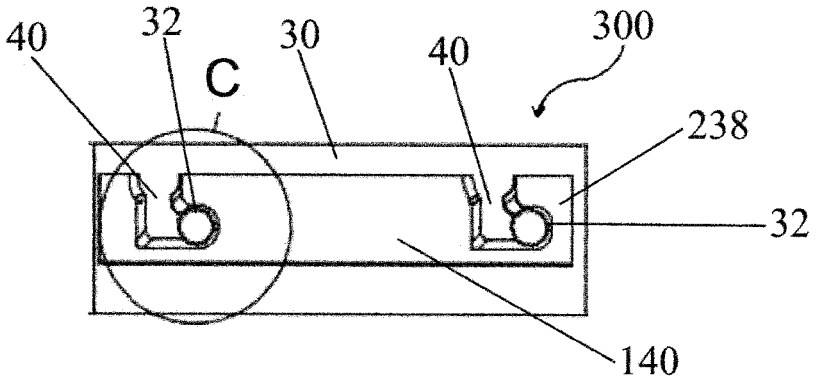
FIG. 20 depicts a top plan view of an example affixation of a second alternate cover connector piece with the base connector piece, according to an example embodiment.

Referring to FIGS. 18-20, an embodiment of the base connector piece 30 and the cover connector piece 138 is generally designated 200. In particular, the dividing line between the top half 142 and the bottom half 140 is at the interface between the top wall 51 and the angled side wall 48.

Figure 21:
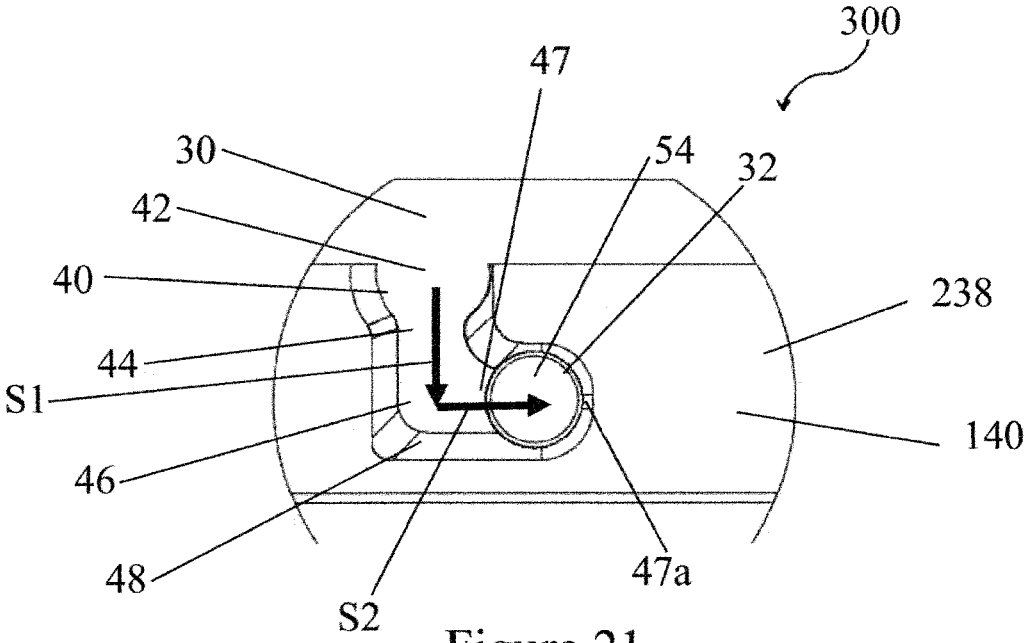
FIG. 21 depicts an enlarged view of an example affixation of the second alternate cover connector piece with the base connector piece of FIG. 20, according to an example embodiment.

FIGS. 21 and 22 depict an embodiment of the base connector piece 30 and an alternate embodiment of the cover connector piece 238, which is generally designated 300. In particular, the cover connector piece 238 includes the bottom half 140, but no the top half 142. Optionally, the pin 32 contacts the lower planar surface 23 of the cover 14. Alternatively, the bottom half 142 has a thickness greater than the thickness of the pin 32, and the head 54 of the pin 32 does not contact the lower planar surface 23 of the cover 14.

FIG. 22 depicts a method of assembling the sandal 10. Specifically, the pin 32 enters the inlet 42 of the receptacle 40 and slides in a first direction S1 which is an inlet direction of the receptacle. Once the pin 32 reaches the bottom 46, the pin slides in a second direction S2, which is preferably perpendicular to the inlet direction S1, until the pin engages with the end 47*a* of the protrusion 47. As a result, the pin 32 is secured within the receptacle 40. As the foot of the wearer pushes up and forward on the foot cover 14, the pins 32 push against the end 47*a* of the protrusion 47 facilitating a more secure connection. Additionally, when the base 12 strikes the ground (not shown) the upward force applied by the ground causes the pin 32 to press against a top of the end 47*a*, and the cover 14 remains secure on the base 12.

Preferably, the cover 14 includes a cushioning layer and/or an image layer, such that the cushioning layer includes the lower planar surface 23, and the image layer includes the upper planar surface 22. The cover connector pieces 36, 38, and the base connector pieces 28, 30 are preferably made of hard plastic, epoxy resin, or other suitable material known to those in the art. Further, the cushioning layer is preferably made of a durable, flexible material. Finally, the image layer is made of a material, such as but not limited to, synthetic paper with laser printing or sublimation on sublimation compatible materials, to allow unique designs and logos to be transferred onto the top of the foot cover 14. Contemplated are other materials and methods for creating the foot cover 14 as are known in the art. Also contemplated is a transparent foot cover which has no image layer and has only a transparent cushioning layer.

In an example embodiment, the cover connector pieces 36, 38 which are proximate the terminal edges 24, 26, are attached to the lower planar surface 23. Various forms of attachment, such as use of adhesive, are contemplated as are known in the art.

It should be understood that variations on the illustrated sandal 10 are possible. For example, the sandal 10 may take on various sizes and/or shapes, and be constructed from various materials, depending upon the implementation. The sandal is configured for wear on a left foot, and is part of a pair that includes a sandal (not shown) that is a mirror image of sandal 10 and is configured for wear on a right foot.

Numerous modifications will be apparent to those skilled in the art in view of the foregoing description. Accordingly, this description is to be construed as illustrative only and is presented for the purpose of enabling those skilled in the art to make and use what is herein disclosed and to teach the best mode of carrying out same. The exclusive rights to all modifications which come within the scope of this disclosure are reserved.

The invention claimed is:

1. A sandal, comprising:

a base, comprising:

a top surface upon which a human foot rests; and first and second opposed side surfaces, said first and second opposed side surfaces each having at least one pin; and a foot cover, selectively detachable from said base, comprising:

a planar surface with a first terminal edge and a second terminal edge; and at least one cover connector proximate each of said first and second terminal edges and attached to said foot cover, wherein said at least one cover connector defines a cavity for receipt of said at least one pin, said cavity being formed by:

a first surface which is a surface of said cover connector closest to said base, said first surface including:

an inlet;

a neck connected to said inlet; and a bottom connected to said neck, wherein said bottom comprises a protrusion extending from a side of said bottom, such that said pin engages with an end of said protrusion when said sandal is assembled; and side walls which extend from said first surface, said side walls including a first segment which is linear and which forms an oblique angle λ with respect to said first surface such that a portion of said cavity farthest from said first surface has a width greater than a width of said cavity at said first surface.

2. The sandal of claim 1, wherein said at least one pin comprises:

a head;

a shaft with a diameter smaller than a diameter of said head; and a neck connecting said shaft to said head, wherein said neck is chamfered at an angle δ with respect to said first opposed side surface or second opposed side surface.

3. The sandal of claim 2, wherein said first and second opposed side surfaces each have a base connector piece, said base connector piece comprising:

a plate, and a pair of said pins which are attached to, or integral with, said plate, wherein an interface between said shaft and said plate includes a fillet.

4. The sandal of claim 2, wherein a width of said inlet is greater than a width of said neck but less than a width of said bottom, wherein said inlet, said neck, and said bottom form an L-shape such that said protrusion extends in one direction beyond said neck.

5. The sandal of claim 4, wherein said protrusion extends perpendicularly to an inlet direction of said at least one pin, and wherein a length of said protrusion is greater than a diameter of said head.

6. The sandal of claim 3, wherein said angle λ is equal to said angle δ, such that said neck is flush with said angled side walls when said sandal is assembled, and wherein said angled side walls include a vertical segment that is perpendicular to said edge surface.

7. The sandal of claim 6, wherein said edge surface engages a surface of said plate with said pair of pins.

8. A selectively detachable foot cover for sandals, comprising:

a body having a planar surface with a first terminal edge and a second terminal edge; and at least one cover connector defined proximate each of said first and second terminal edges and attached to said body, wherein said cover connector defines a cavity for receipt of at least one pin of a base of the sandal, said cavity being formed by:

a first surface which is a surface of said cover connector closest to a base of the sandal, said first surface including:

an inlet;

a neck connected to said inlet; and a bottom connected to said neck, wherein said bottom comprises a protrusion extending from a side of said bottom, such that the at least one pin engages with an end of said protrusion when the sandal is assembled; and side walls which extend from said first surface, said side walls including a first segment which is linear and which forms an oblique angle λ with respect to said first surface such that a portion of said cavity farthest from said first surface has a width greater than a width of said cavity at said first surface.

9. The selectively detachable foot cover of claim 8, wherein a width of said inlet is greater than a width of said neck but less than a width of said bottom, wherein said inlet, said neck, and said bottom form an L-shape such that said protrusion extends in one direction beyond said neck.

10. The selectively detachable foot cover of claim 9, wherein said protrusion extends perpendicularly to an inlet direction of said corresponding pin, and wherein a length of said protrusion is greater than a diameter of a head of said corresponding pin.

11. The selectively detachable foot cover of claim 10, wherein said corresponding pin comprises:

a head;

a shaft with a smaller diameter than said head; and a neck connecting said shaft to said head, wherein said neck is chamfered at an angle δ with respect to a top surface of said head.

12. The selectively detachable foot cover of claim 11, wherein said angle λ is equal to said angle δ, such that said neck is flush with said angled side walls when said selectively detachable foot cover is assembled on a sandal, and wherein said angled side walls include a vertical segment that is perpendicular to said edge surface.

13. A sandal, comprising:

a base, comprising:

a top surface upon which a human foot rests; and first and second opposed side surfaces, said first and second opposed side surfaces each having at least one pin; and a foot cover, selectively detachable from said base, comprising:

a planar surface with a first terminal edge and a second terminal edge; and at least one cover connector defined proximate each of said first and second terminal edges and attached to said planar surface of said foot cover, wherein said at least one cover connector defines a cavity for receipt of said at least one pin, said cavity being formed by:

a first surface which is a surface of said cover connector closest to said base, said first surface including:

an inlet;

a neck connected to said inlet; and a bottom connected to said neck, wherein said bottom comprises a protrusion extending from a side of said bottom, such that said at least one pin engages with an end of said protrusion when said sandal is assembled, wherein a width of said inlet is greater than a width of said neck, wherein said protrusion extends in a direction beyond said neck toward a back of said base where a heel of the human foot rests, wherein said protrusion includes first and second parallel edges, said first parallel edge being closer to said inlet than said second parallel edge such that a width of said protrusion between said first and second parallel edges is equal to said width of said neck, and wherein an intersection between said bottom and said first parallel edge is rounded.

14. The sandal of claim 13, wherein said protrusion extends perpendicularly to an inlet direction of said corresponding pin, and wherein a length of said protrusion is greater than a diameter of a head of said corresponding pin.

15. A selectively detachable foot cover for sandals, comprising:

a body having a planar surface with a first terminal edge and a second terminal edge; and at least one cover connector defined proximate each of said first and second terminal edges and attached to said planar surface of said body, wherein said cover connector defines a cavity for receipt of a pin of a base of the sandal, said cavity being formed by:

a first surface which is a surface of said cover connector closest to a base of the sandal, said first surface including:

an inlet;

a neck connected to said inlet; and a bottom connected to said neck, wherein said bottom comprises a protrusion extending from a side of said bottom, such that the pin engages with an end of said protrusion when the sandal is assembled, wherein a width of said inlet is greater than a width of said neck, wherein said protrusion extends in a direction beyond said neck toward a back of the base where a heel of the human foot rests, wherein said protrusion includes first and second parallel edges, said first parallel edge being closer to said inlet than said second parallel edge such that a width of said protrusion between said first and second parallel edges is equal to said width of said neck, and wherein an intersection between said bottom and said first parallel edge is rounded.

16. The selectively detachable foot cover of claim 15, wherein said protrusion extends perpendicularly to an inlet direction of said corresponding pin, and wherein a length of said protrusion is greater than a diameter of a head of said corresponding pin.

17. The sandal of claim 1, wherein said side walls include a second segment which connects the first segment and the first surface, such that said second segment is linear and is perpendicular with said first surface.

18. The selectively detachable foot cover of claim 8, wherein said side walls include a second segment which connects the first segment and the first surface, such that said second segment is linear and is perpendicular with said first surface.

* * * * *